United States Patent [19]

Cross et al.

[11] 3,961,687

[45] June 8, 1976

[54] LUBRICATION OF ROTATABLE MEMBERS

[76] Inventors: Michael Ellison Cross, 52 Bloomfield Ave.; Albert Edward Coles, 366 Bloom Road, both of Bath, England

[22] Filed: Sept. 6, 1974

[21] Appl. No.: 504,686

[30] Foreign Application Priority Data

Sept. 7, 1973 United Kingdom..... 42107/73

[52] U.S. Cl. ..... 184/6.9

[51] Int. Cl.[2] ..... F01M 9/10

[58] Field of Search..... 184/6, 6.9; 123/196 R, 123/196 VS, 190 R, 190 SL, 190 C

[56] References Cited

FOREIGN PATENTS OR APPLICATIONS 423,474 2/1935 United Kingdom..... 184/9

*Primary Examiner*—Richard C. Pinkham
*Assistant Examiner*—Marvin Siskind
*Attorney, Agent, or Firm*—Emory L. Groff, Jr.

[57] ABSTRACT

Apparatus for removing the excess lubricant from a rotatably mounted cylindrical valve member for internal combustion engines, pumps and compressors includes a rigid scraper blade mounted within a housing and resiliently biased toward the surface of the cylindrical valve member. The lubricant is supplied copiously to the surface of the cylindrical member at one position and is removed as the cylindrical member rotates at a second position by the rigid blade which has an extremely small degree of flexibility so that it is deformed by an amount not greater than 1/3000 of the diameter of the cylindrical valve member when the blade and a recess in the cylindrical valve member are in register.

5 Claims, 6 Drawing Figures

LUBRICATION OF ROTATABLE MEMBERS

This invention relates to improvements in the lubrication of rotatable members, and comprises a means for removing the excess lubricant from a cylindrical member rotatably mounted within a housing.

The invention is particularly applicable to the lubrication of rotatable members such as rotary valves for internal combustion engines, pumps and compressors. Rotary valves for such applications are required to be lubricated effectively, without permitting significant amounts of lubricant to be carried into areas where its presence is undesirable, for example the combustion chambers in the case of an internal combustion engine. The invention, although not limited thereto, is more particularly described herein with reference to the lubrication of rotary valves for internal combustion engines.

A prior device shows internal combustion engine, wherein lubricating oil is supplied through a hole, or holes, in the valve housing to the cylindrical surface of a rotatable valve member, and is carried around by the valve member to an exit duct in the valve housing spaced circumferentially from the lubricant feed hole, or holes. The lubricant is removed from the valve member at the exit duct by a scraper device, and alternative forms of scraper device are useable. In one form, scraping is effected by a single, resilient and flexible scraper blade, and in an alternative form scraping is performed by a rigid metal plate grooved longitudinally to form a series of tongues. The alternative form of scraper has not proved satisfactory, and although the single resilient and flexible scraper blade is substantially more effective than the grooved rigid metal plate, it is still not as satisfactory as is desirable. It is found that with such a scraper blade, an undesirable amount of lubricant is still liable to reach the combustion chamber and to burn therein forming an unwanted amount of carbonaceous deposit; the flexibility of the blade has been found to be disadvantageous particularly when the valve ports pass over the blade which then is supported only at its ends. Additionally, the removal of the lubricating oil scraped off the rotary valve member is difficult to achieve effectively with a flexible blade.

This invention aims at improving the forms of scraper in such prior art devices.

According to one aspect of this invention, there is provided means for removing excess lubricant from a cylindrical member rotatably mounted within a housing, the cylindrical member having a recess formed in its cylindrical surface, which means comprises a rigid scraper blade mounted within the housing and resiliently biassed towards the cylindrical surface of the member, the axial extent of the scraper blade being greater than that of the recess, and the magnitude of the resilient bias coupled with the rigidity of the scraper blade being such that the blade is deformed by an amount not greater than 1/3000 of the diameter of the rotatable member when the recess and blade are in register.

When the invention is applied to the rotary valve of an internal combustion engine, the cylindrical member is the rotary valve member, whereas the housing is the valve housing having an opening for communication with the combustion chamber. The recess in the cylindrical member comes into and out of communication with the opening in the housing as the valve member rotates, and serves to connect the opening to either an inlet or an exhaust port of the valve, as appropriate. Typically, two recesses are provided, one associated with the inlet port and the other associated with the exhaust port, the recesses coming into and out of communication with the opening, in turn. It will be appreciated that this invention thus allows a copious amount of lubricant to be supplied to the valve member immediately beyond the port in the housing (having regard to the normal sense of rotation of the valve member), the scraper blade serving to remove all the excess lubricant before the valve member passes over the port, and hence before the lubricant can be carried, by rotation of the valve member, through the portion into the combustion chamber. By supplying a copious amount of lubricant, substantial cooling of the valve can be effected as well as lubrication thereof. The improved scraper device of the invention has a single scraping edge which, of itself, is essentially rigid but which is resiliently pressed against the surface from which the lubricant is being scraped, in contrast to the resilient and flexible single scraper blade of prior devices. The single edge of the scraper blade is self-bedding against the cylindrical surface and if the edge wears, the wear will be substantially even and compensated by the resilient pressure applied to the scraper; the resilient pressure also enables the scraper blade to adjust itself to thermal expansion in the system in which it operates.

The resilient bias for the scraper blade preferably comprises a series of springs disposed so as to urge the blade into contact with the cylindrical surface of the valve member.

The scraper device should be associated with a passage in the housing to allow draining of lubricant removed from the cylindrical surface by the scraper blade, and conveniently the scraper blade itself has a plurality of apertures or channels which allow lubricant to pass from the scraping edge of the scraper blade to the passage. Furthermore, one or more non-return valves should be provided in the passage to prevent the return of removed lubricant during operation of the valve.

To facilitate the removal of lubricant taken from the cylindrical surface by the scraper, the or each non-return valve should function to create an area of reduced (i.e., sub-atmospheric) pressure in the area behind the scraper blade. The creation of this reduced pressure may be assisted by the employment of a vacuum pump, suitably driven by the engine.

According to a further aspect of this invention, lubricant is copiously supplied to the cylindrical surface at one position and is removed subsequently at a second position, spaced from the one position, by a scraper blade of greater axial extent than the recess and resiliently biassed into engagement with the cylindrical surface, the rigidity of the scraper blade and the magnitude of the bias being such that the blade is deflected by not more than 1/3000 of the diameter of the cylindrical member when the blade and the recess are in register.

When the cylindrical member and housing respectively serve as a rotary valve member and a valve housing of a rotary valve for a reciprocating piston internal combustion engine, pump, compressor or the like, an opening will be provided in the housing for communicating with the working chamber of the engine, pump, compressor or the like. The scraper blade will in this case be located before the opening, having regard to the normal sense of rotation of the valve member so as to prevent lubricant being carried by the member to the opening.

The valve member may have two recesses formed therein, one associated with an inlet port for the valve, and the other associated with an exhaust port for the valve, the two recesses coming in turn into and out of communication with the opening in the housing. In this case, and in which there is a passage associated with the scraper blade to allow draining of the lubricant removed, the passage being fitted with a non-return valve, when the recess associated with the exhaust port passes the scraper blade the associated non-return valve is adapted to be opened by exhaust gas pressure, allowing the lubricant removed by the scraper to escape. When the recess associated with the inlet port passes the scraper blade, the suction caused by the downward stroke of the piston is adapted to cause the non-return valve to be drawn back on to its seating so as to prevent lubricant removed by the scraper device from being sucked back into the engine. To assist the free return of lubricant to its source of supply, it has been found advantageous to provide a second non-return valve, located in the passage remote from the first-mentioned non-return valve and hence near the base of the engine cylinder or near the point of entry of the drained lubricant to the crankcase. This second non-return valve is adapted to be actuated by the fluctuating pressures in the crankcase caused by the reciprocating movement of the piston. When the inlet port of the valve opens, the piston is near top dead centre and the first non-return valve is closed; pressure in the crankcase is consequently low allowing the second non-return valve to open and release to the source of supply lubricant in the passage between the two non-return valves. When the exhaust port of the valve opens, the piston is nearing bottom dead centre and crankcase pressure is high causing the second non-return valve to close and so prevent crankcase pressure from impeding lubricant removed by the scraper device from entering the passage. The effect of the two non-return valves is to maintain a reduced pressure in the passage between them, and thus to facilitate the rapid draining of lubricant removed by the scraper device. Further non-return valves may be provided to enhance this effect.

As an alternative, or in addition, to utilising the fluctuating pressure in the crankcase to assist the return of lubricant removed by the scraper blade, a separate vacuum pump may be employed to produce a reduced pressure in the passage leading from the first-mentioned, or sole where there is only one, non-return valve; this is of advantage when the invention is used with engines so designed that the position of the cylinder does not allow the removed lubricant to flow by gravity to its source of supply.

The feed of lubricant to the valve, and its subsequent removal by the scraper device, should be arranged so that maximum lubrication is supplied to the valve member as it rotates beyond the opening to the cylinder, and excess lubricant is removed before it can be carried by the rotation of the valve member through the opening into the combustion chamber. This ensures that lubricant does not enter the cylinder in undesired amounts, which would otherwise burn in the combustion chamber and form undesirable carbon deposits.

In a preferred form of the invention sealing lips, over which the valve member is adapted to pass, are provided in the housing around the opening therein. These sealing lips, preferably, are maintained in contact with the cylindrical member under the influence of gas pressure generated in the cylinder. It is also preferred to construct the housing in two parts, split diametrically, means being provided to urge the two parts together. In one embodiment of the invention, one part of the housing is integral with the cylinder head of the engine, and the other part is hinged thereon; the other part is connected back to the engine crankcase to prevent its movement away therefrom and the one part is resiliently biassed towards the other part by means of springs interposed between the engine cylinder and its crankcase. This arrangement allows the combustion force to urge the cylinder towards the other part of the housing, thereby improving the sealing of the lips on the cylindrical member when combustion is taking place. Conveniently, the resilient force may be adjusted by moving the relative position of the other member with respect to the crankcase; the nearer the other member, the more it will force the cylinder against its bias towards the other member.

When this invention is applied to a rotary valve, it enables there to be a plentiful supply of lubricant, where loads are highest, i.e., the area of contact between the housing and cylindrical member opposed to the opening to the cylinder. Also, as previously mentioned, sufficient lubricant can be fed to the valve to have an important influence on its cooling, in addition to providing effective lubrication. This cooling is most important in allowing the engine to operate at high compression ratios on low octane fuels - which is not possible in a poppet valve engine owing to the high operating temperature of the exhaust poppet valve, since pre-ignition would occur.

The invention will now be described in greater detail, though by way of illustration only, reference being made to the accompanying drawings, in which.

Figure 1:
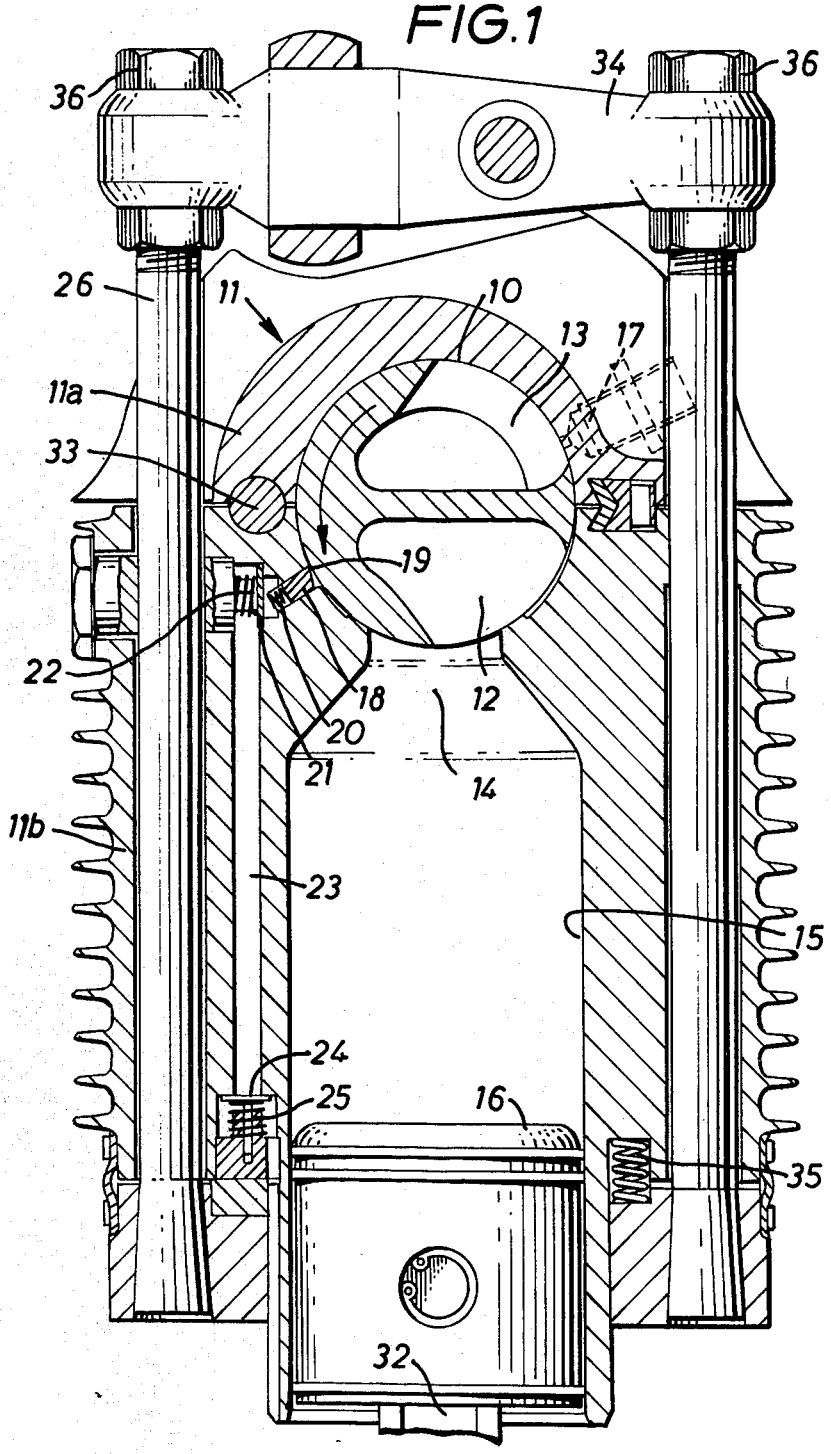
FIG. 1 is a vertical section of an engine cylinder, the flow of gases thereto and therefrom being controlled by a rotary valve.

Referring now to FIG. 1, 10 is a cylindrical rotary valve member adapted to rotate, as shown, in an anti-clockwise direction in a housing 11, controlling, through an inlet port 12 and an exhaust port 13, the inlet to and exhaust from a combustion chamber 14 of an engine cylinder 15 in which a piston 16, actuated by a connecting rod 32, is adapted to reciprocate. Lubricating oil is delivered to the rotary valve 10 at 17 and removed by a scraper device 18 provided with a scraper blade 19 influenced against the valve 10 by springs 20. A non-return valve 21, influenced by a spring 22, controls an exit passage 23 for draining lubricant removed by the scraper device 18 from the valve 10. 24 is a further non-return valve influenced by a spring 25 and positioned further along the passage 23 from the valve 21. As shown in the drawing, the housing 11 is split into parts 11*a* and 11*b* hinged at 33 and urged together by a resilient bias provided by springs 35. Guides 26 attached to the engine crankcase support, by means of nuts 36, a cross beam 34 arranged to bear on the upper part 11*a* of the housing, the cylinder 15 including the lower part 11*b* of the housing and being urged upwardly by the springs 35.

Figure 2:
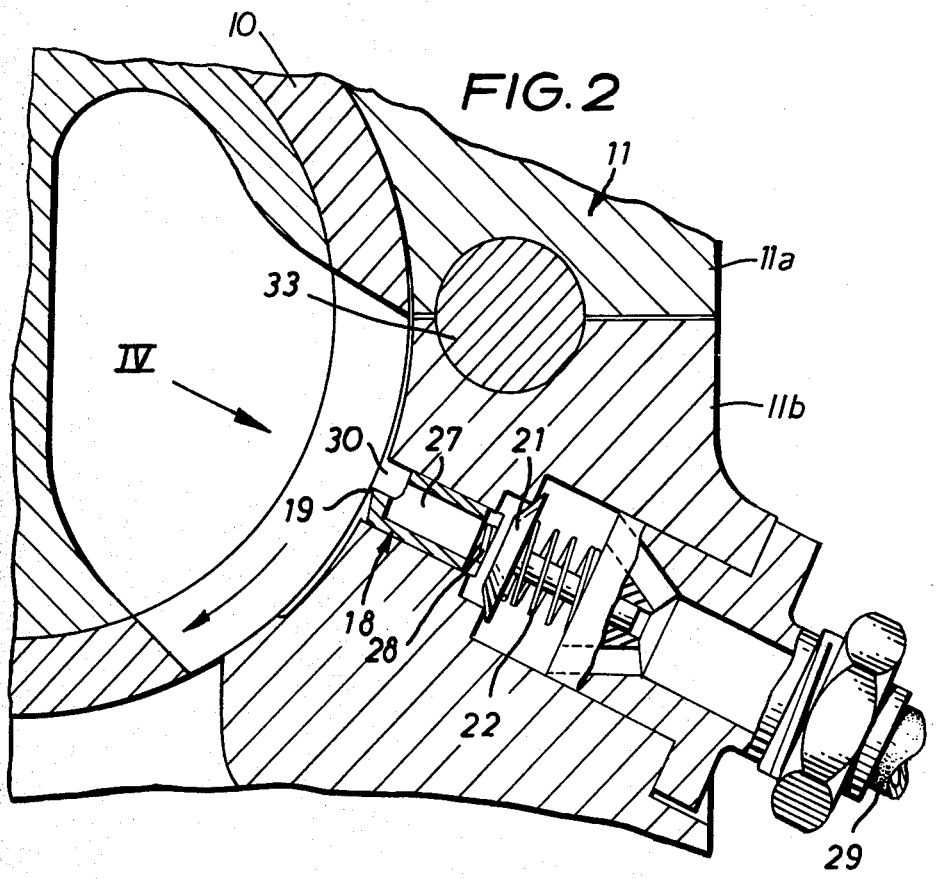
FIG. 2 is a part-section of a rotary valve having a scraper device.
Figure 3:
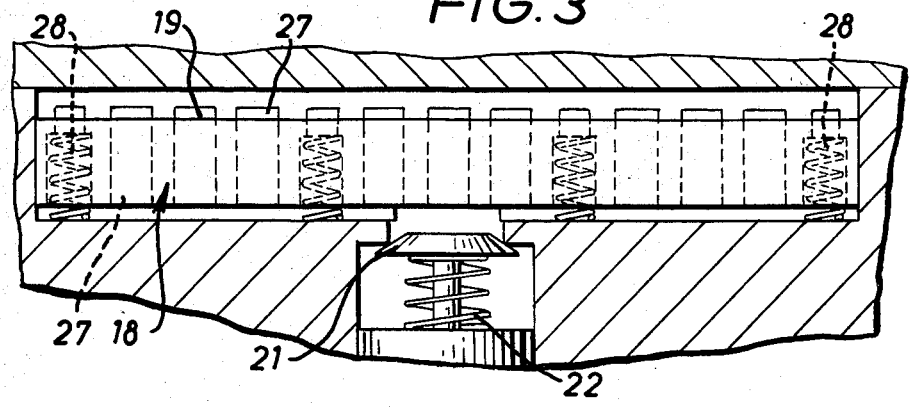
FIG. 3 is a longitudinal section of the scraper device shown in FIG. 2.
Figure 4:
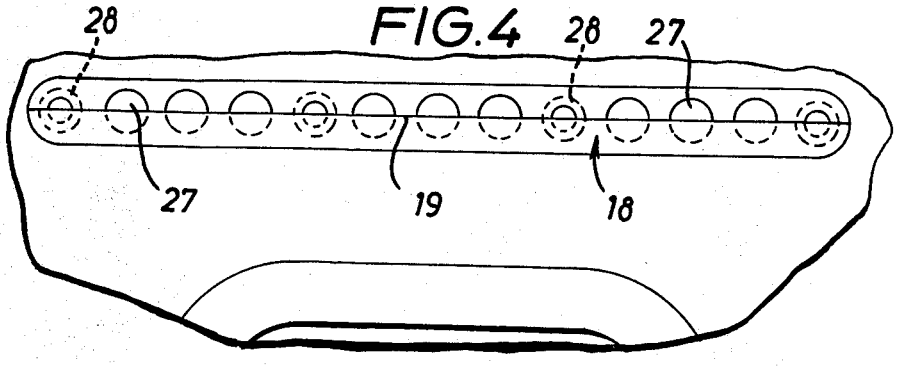
FIG. 4 is a view on arrow IV in FIG. 2, but with the rotary valve removed.

FIG. 2 shows the rotary valve of FIG. 1 in greater detail, but from the other side thereof so that in the Figure its rotation is clockwise, as shown. Referring to FIGS. 2, 3 and 4 the scraper device 18 has a scraper blade 19 urged into contact with the cylindrical surface of the rotary valve member 10 by springs 28. The edge of the scraper blade 19 is cut away to provide a slot 30 in communication with holes 27 formed in the blade 19. Lubricant removed from the valve member 10 by the blade 19 collects in the slot 30, enters holes 27 and drains into passage 29 through the non-return valve 21, 22.

Figure 5:
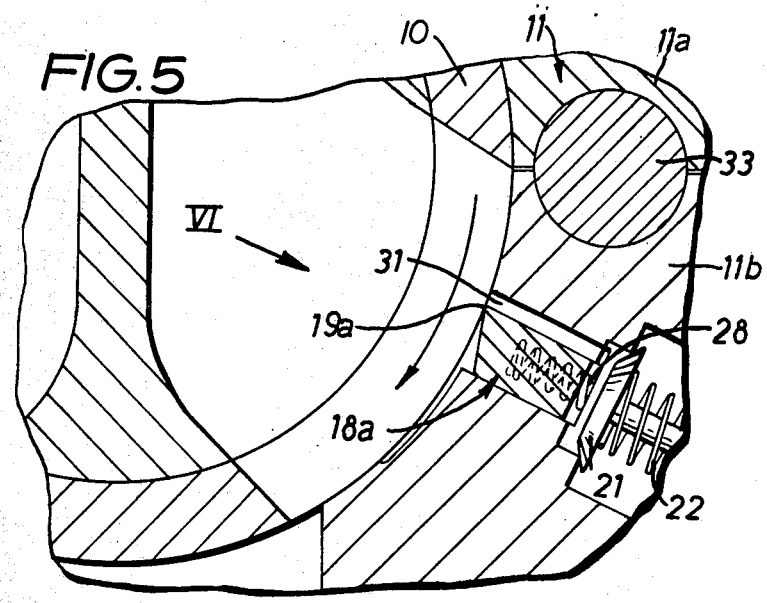
FIG. 5 is a view similar to that of FIG. 2 but showing an alternative form of scraper device.
Figure 6:
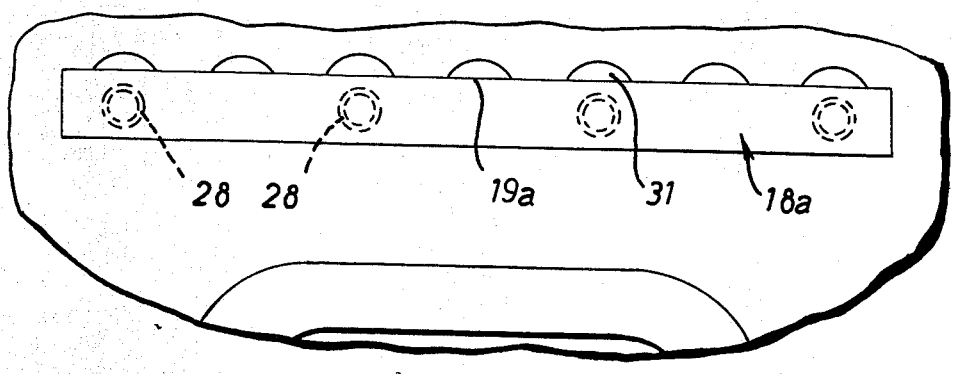
FIG. 6 is a view on arrow VI in FIG. 5, but with the rotary valve removed.

FIGS. 5 and 6 show an alternative form of scraper device 18*a*, the rotation of the valve member 10 in FIG. 5 again being clockwise. The scraper blade 19*a* of the device 18*a* is located in a slot in housing 11*b* and is biassed into contact with the valve member 10 by springs 28. The slot is provided with grooves 31, through which lubricant removed from the valve member 10 may drain to the non-return valve 21, 22.

The scraper blade 19 (or 19*a*) may be formed of any material having good wear and bearing qualities against the rotary valve; e.g. the scraper blade may be of bronze and the rotary valve of hardened steel or hard iron. The axial extent of the scraper blade must be greater than that of the ports 12 and 13, and hence when the ports are passing the scraper device, the scraper blade is supported only at its ends. It is necessary therefore for the blade to be rigid, so as to prevent the blade being deflected into the ports, and it is found that the rigidity of the blade coupled with the force exerted by the springs 28 should be such that the blade is deflected by not more than 1/3000 of the valve member diameter when the blade and a port are in register. Desirably, the total volume for air within the slot in which the blade is located and on the valve member side of the non-return valve 21 is maintained as small as possible consistent with the effective draining of lubricant scraped off by the blade. This is because air in these spaces will expand as the inlet port arrives at the scraper device since the inlet pressure normally will be subatmospheric, whereas these spaces will be charged with air at superatmospheric pressure when the exhaust port arrives thereat. The expanding air will tend to carry into the inlet port some of the lubricant removed by the scraper blade; thus the smaller the free volume in the region of the scraper device the less will be this tendency. This requirement, however, must be reconciled by the need for the scraper device to be able to drain away the removed lubricant sufficiently rapidly to prevent it building up as a pressurised film at the scraping edge which could allow the rotating valve member to carry lubricant past the scraper blade. If there is a thick film of lubricant on the valve member in the region of the opening into the combustion chamber, the pressures there developed can cause problems such as vibration of the valve member.

It is found that the lubricant removal should be sufficiently effective to produce a very thin oil film on the rotor between the scraper blade and the delivery means 17 if these problems are to be avoided. Such thin films fall within the theory of elastohydrodynamic lubrication, and the formula derived by Dowson and Higgenson (set out below) is found to apply. From this formula, a value for $H_{min}$ can be calculated, and for the diameters of valve members which are used in this invention, the actual minimum oil film thickness resent on the rotor after scraping should be of the order of 40 to 50 $\mu$ in. (i.e., 1.00 to 1.25$\mu$ m).

The formula of Dowson and Higgenson, set out in "Elastohydrodynamic Lubrication", published by Pergamon Press, 1966, is as follows:

$$H_{min} = 2.65 \frac{U^{0.70} \times G^{0.57}}{W^{0.13}}$$

where

H = dimensionless oil film thickness parameter = h/R
W = W/E'R = dimensionless load parameter
U = $\eta$u/E'R = dimensionless speed parameter
G = $\alpha$E' = dimensionless materials parameter
h = actual film thickness
R = radius of rotor
w = load/unit width
E' = Youngs modulus of housing material in the region of the thin film
u = sliding velocity between rotor and housing
$\eta$ = viscosity of lubricant
$\alpha$ = pressure exponent of viscosity to take account of changes in viscosity of the lubricant caused by the high pressures prevailing.

In operation of this invention, as described, lubricant is delivered to the valve member at 17 and is carried around by the rotation of the valve member 10 to the scraper device 18 whereat it is substantially removed before it can reach the combustion chamber 14. The removed oil passes via the non-return valve 21, passage 23 and non-return valve 24 to its source (and typically the engine sump) whence it can be recirculated to the valve at 17. It will be appreciated that the lubricant will cool the valve as well as lubricate it, and for the former purpose it is desirable for there to be a high flow rate over the valve.

Although the invention has been described in detail with reference to its application to the lubrication and cooling of rotary valves for internal combustion engines, it is to be understood that the invention is generally applicable to the removal of liquid lubricants from rotating surfaces at a predetermined position.

What is claimed is:

1. An assembly for removing excess lubricant from a rotatably mounted cylindrical valve member comprising a housing, a cylindrical member rotatably mounted within the housing, a recess formed in the cylindrical surface of the cylindrical member, the housing defining an opening which comes into and out of communication with the said recess as the valve member rotates, means to supply lubricant to the cylindrical member within the housing, means to remove excess lubricant from the surface of the cylindrical member comprising a rigid scraper blade mounted within the housing and resiliently biased towards the surface of the rotatable cylindrical member, the axial extent of the rigid scraper blade being greater than that of the recess and the magnitude of the resilient bias coupled with the rigidity of the scraper deforming the rigid scraper blade by an amount not greater than 1/3000 of the diameter of the rotatable member when the recess and the blade are in register, a passage provided in the housing to allow draining of lubricant removed by the scraper blade and one or more non-return valves located in the said passage to produce an area of reduced pressure to assist in the draining of lubricant removed by the scraper blade.

2. An assembly as claimed in claim 1 wherein said resilient bias is provided by a series of separate springs disposed in the housing and bearing on the rigid scraper blade.

3. A rotary valve for controlling the inlet of fuel to and removal of exhaust gases from a combustion chamber of an internal combustion engine comprising, a valve housing defining a bore and having an opening communicating with said combustion chamber, a cylindrical valve member rotatably mounted within the housing, at least one recess formed in the surface of the cylindrical valve member arranged to come into and out of communication with the opening in the housing, means to supply lubricant to the cylindrical valve member through the housing, means to remove excess lubricant from the surface of the cylindrical member which removal means comprises a rigid scraper blade mounted within the housing and resiliently biased towards the surface of the cylindrical member, the axial extent of the rigid scraper blade being greater than the diameter of the recess and the magnitude of the resilient bias coupled with the rigidity of the scraper arranged to deform the blade by an amount not greater than 1/3000 of the diameter of the rotatable member when the recess and the blade are in register, the housing being formed in two parts with said opening in one of the parts, means to apply a pre-load to urge the said two parts together, which means apply to the other of the said parts a force adapted to maintain the valve member in contact with the wall of said one part around the opening during operation of the valve, a passage in the housing to allow drainage of lubricant removed from the scraper blade and one or more non-return valves located in said passage to produce an area of reduced pressure to assist in draining of lubricant removed by the scraper blade.

4. An assembly according to claim 3, in which upstanding sealing lips are provided in the housing around the opening for engaging with the cylindrical member to effect a seal thereagainst.

5. An assembly as claimed in claim 3 wherein said resilient bias is provided by means of a series of separate springs disposed in the housing and bearing on the rigid scraper blade.

* * * * *